US006918491B2

(12) United States Patent
Moss et al.

(10) Patent No.: US 6,918,491 B2
(45) Date of Patent: Jul. 19, 2005

(54) DISPLAY STAND WITH FOLDABLE SELF ERECTING SUPPORTING BASE

(76) Inventors: Geoffrey Alan Moss, 56 Genoa Road, Maple, Ontario (CA), L6A 2Y4; David Brian Minister, 1 Red Cedarway, Toronto, Ontario (CA), M1B 1A1

( * ) Notice: Subject to any disclaimer, the term of this patent is extended or adjusted under 35 U.S.C. 154(b) by 40 days.

(21) Appl. No.: 10/616,213

(22) Filed: Jul. 10, 2003

(65) Prior Publication Data

US 2005/0006277 A1 Jan. 13, 2005

(51) Int. Cl.[7] ..... B65D 5/50; A45D 19/04; A47F 3/14

(52) U.S. Cl. ..... 206/764; 206/45.27; 211/132.1; 248/174

(58) Field of Search ..... 206/736, 764–765, 206/45.22, 45.24, 45.25, 45.27, 45.3, 747; 211/132.1; 248/174, 150

(56) References Cited

U.S. PATENT DOCUMENTS 3,300,166 A * 1/1967 Wojciechowski ..... 248/174
3,836,104 A * 9/1974 Miller et al. ..... 248/150
4,726,476 A * 2/1988 Smith ..... 211/132.1
4,813,536 A * 3/1989 Willis ..... 206/765
6,234,433 B1 * 5/2001 Maglione ..... 248/174
6,488,245 B1 * 12/2002 Maglione ..... 248/174
2003/0150771 A1 * 8/2003 Mason et al. ..... 206/736

* cited by examiner

*Primary Examiner*—Bryon P. Gehman
(74) *Attorney, Agent, or Firm*—David W. Wong

(57) ABSTRACT

A display stand has supporting base which is self-erecting by a pivotal board located within the base. The pivotal board is biased by an elastic cord and is pivotable between a horizontal position transverse to the base and a vertical downward position at which it is juxtaposed to the front panel of the base. The pivotal board is engageable with a horizontal slot opening formed in the rear panel of the base for maintaining the base in the erected condition. The side panels of the base are also foldable inwards along two vertical fold lines formed in the middle therein. A second elastic cord is connected between these fold lines so that it would pull the side panels to fold inwards at the vertical fold lines when the pivotal board is pulled downwards to disengage from the horizontal slot opening. A display tray is disposable in a forward sloping position on the base and the base in the collapsed folded condition may be placed within the tray for shipping, transporting, or storage.

12 Claims, 3 Drawing Sheets

DISPLAY STAND WITH FOLDABLE SELF ERECTING SUPPORTING BASE

FIELD OF THE INVENTION

This invention relates to a display stand having a tray and a self-erecting supporting base which is also foldable in a collapsed condition for packing with merchandise in the tray for shipping, transporting and storage.

BACKGROUND OF THE INVENTION

Display stands made of cardboard or corrugated board material are commonly used for displaying merchandise. Such display stands have either a flat top or a tray for displaying the merchandise. The top is supported by a base which may be folded over or under the tray for storage or transportation. The base is often attached to or integrally formed with the tray such that the display stand is formed readily when the base is erected. The main drawback of such display stands is that the base must be manually and painstakingly unfolded and erected at the merchandise display location. This,process is often rather awkward and frustrating to carry out due to the stiffness of the cardboard material which renders the base difficult to unfold and to erect.

Attempts have been made to provide a self-erecting base attached to the underside of the merchandise packing tray such that the base can be erected by simply lifting the tray upwards. However, the self-erecting operation of the base of such construction is problematic because the folded base tends to retain its collapsed shape permanently and it could not be unfolded by its self-erecting mechanism. This problem is particularly severe when the folded base is compressed for a relatively lengthy period of time by the weight of the merchandise packed in the tray.

SUMMARY OF THE INVENTION

It is a principal object of the present invention to provide a display stand having a self-erecting base in which the self erecting mechanism is effective in unfolding and erecting the base.

It is another object of the present invention to provide a display stand in which the display tray is usable for packing, the merchandise as well as the base folded in the collapsed condition.

It is another object of the present invention to provide a display stand in which the display tray may be removably attached to the base so that the base may be easily separated from the tray for folding and packing it within the tray thereafter.

DETAILED DESCRIPTION OF THE PREFERRED EMBODIMENTS

Figure 1:
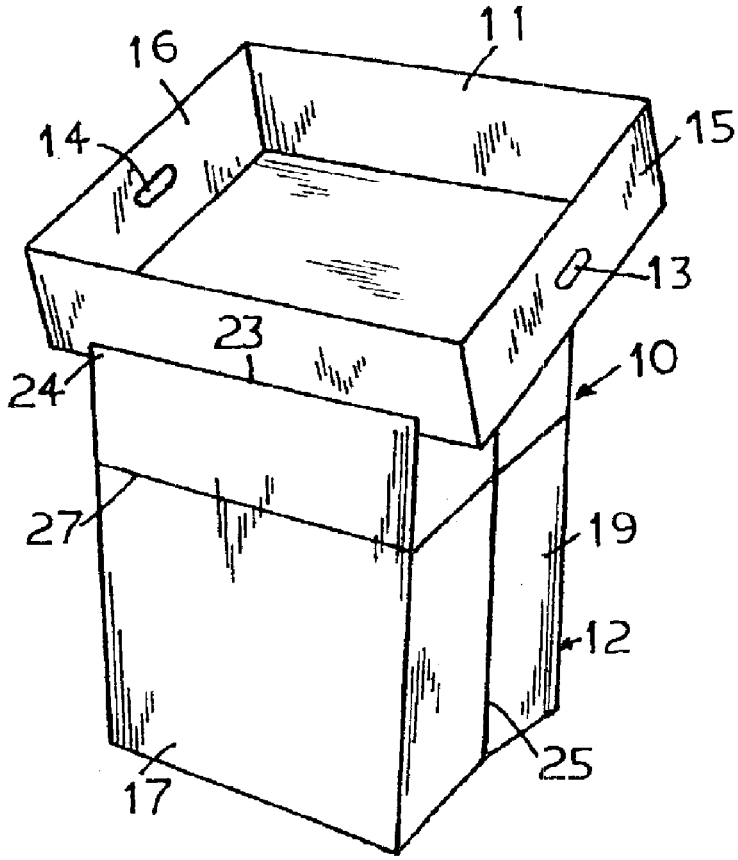
FIG. 1 is a perspective elevation view of the display stand of the present invention in the erected condition.

With reference to the drawings, the display stand 10 of the present invention has a display tray 11 disposed on top of a substantially rectangular base 12. The tray 11 may be used for packing the merchandise for transportation, shipping, and for displaying the merchandise when the stand is erected. The tray 11 is generally rectangular in shape and is provided with two handle openings 13 and 14 on two opposite side walls 15 and 16 respectively to facilitate its handling.

The base 12 has a generally rectangular horizontal cross sectional shape and it may be slightly larger at the bottom and tapering upwards to a smaller top end so as to provide better stability when the base is standing on a supporting surface. The front panel 17 is shorter in height than the rear panel 18, such that when the tray 11 is placed on the stand it may be in a slanted position to provide a better view of the merchandise displayed therein. The two side panels 19 and 20 have sloping top edges 21 and 22 sloping from the top corners of the taller rear panel 18 to a location slightly below the top edge 23 of the shorter front panel 17 such that a short upstanding lip 24 of the front panel 17 extends above the front corners of the side panels 19 and 20. The upstanding lip 24 serves as an abutment for the front edge of the tray 10 when the latter is placed on the base.

Figure 4:
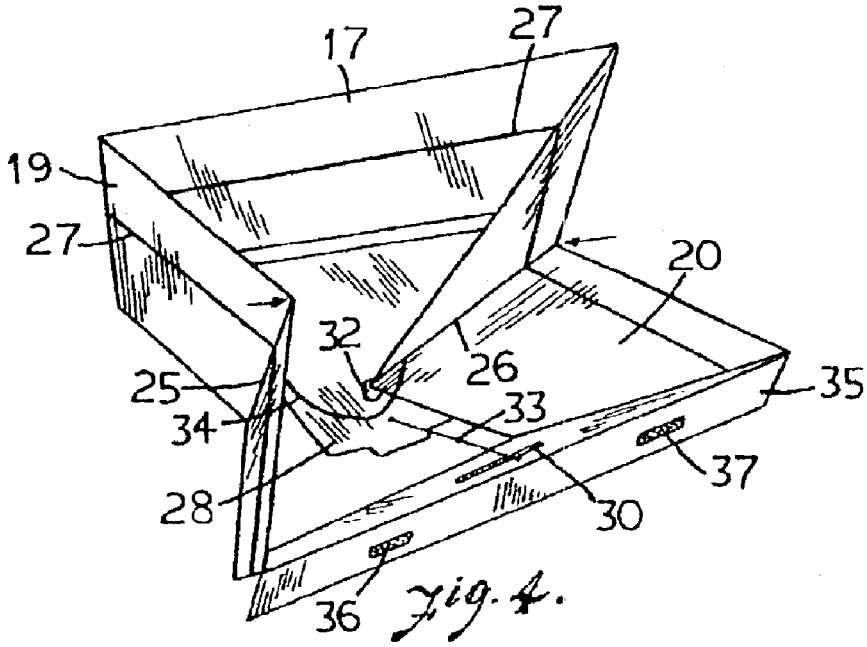
FIG. 4 is a top perspective elevation view of the base with the tray removed and with the pivotal board pulled downwards and the side panel pulled partially inwards by the biassing elastic cord connected between the side panels.
Figure 5:
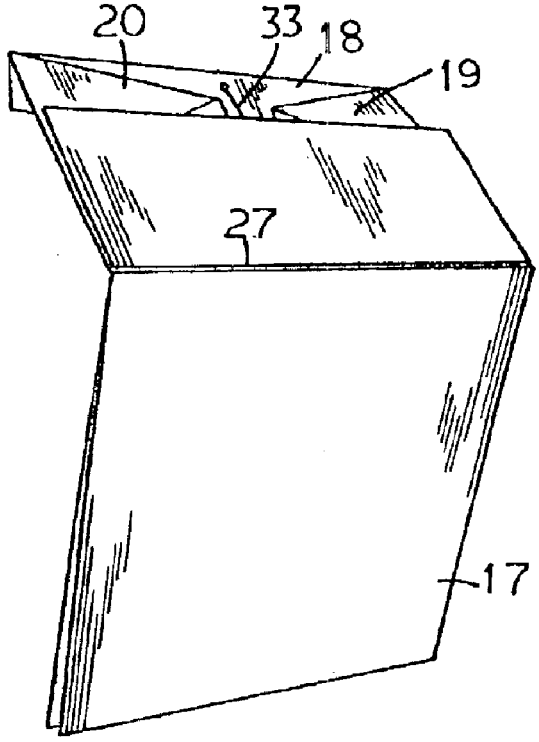
FIG. 5 is a front perspective elevation view showing the base in a collapsed condition.
Figure 6:
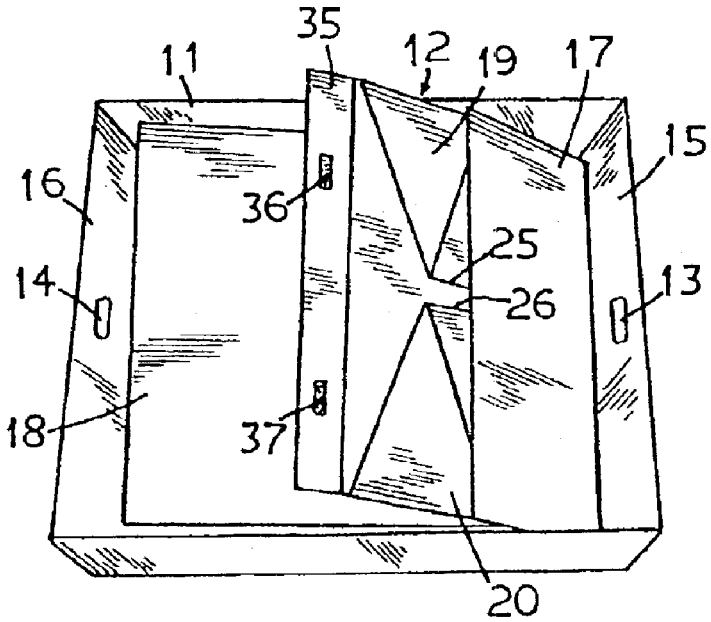
FIG. 6 is a perspective elevation view of the tray with the folded base fully located therein.

Two vertical fold lines 25 and 26 are provided at the middle of the side panels 19 and 20 respectively and they extend the entire length of these side panels such that the side panels 19 and 20 may be pushed inwards at these vertical fold lines, as best shown in FIG. 4, to fold the base into a collapsed condition with the front panel 17 lying juxtaposed to the rear panel 18. A horizontal fold line 27 is provided all around the base 12 and located in horizontal plane at a short distance from the top edges of the front, rear, and side panels such that the base 12 in the collapsed condition may be further folded along the horizontal fold line 27 as best shown in FIGS. 5 and 6. In this collapsed and folded condition, the base 12 may be conveniently packed within the tray 10 as shown in FIG. 6.

Figure 3:
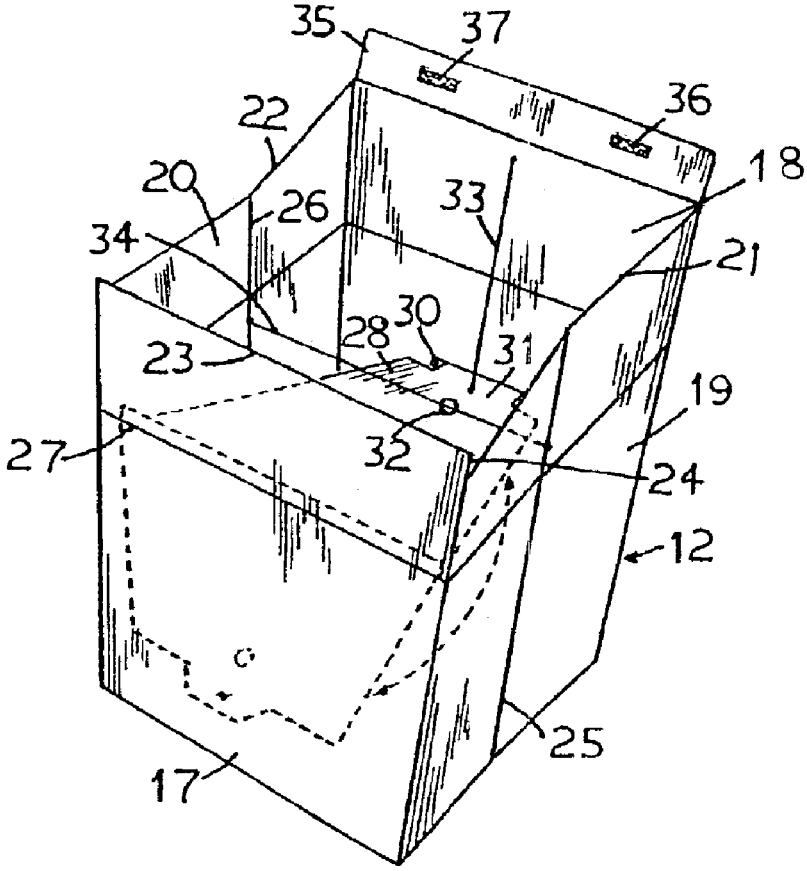
FIG. 3 is a top perspective elevation view of the base with the tray removed showing the elastic biased trapezoidal shape pivotal board of the self-erecting mechanism.

A generally trapezoidal-shaped wedge pivotal board 28 is located in a horizontal manner in the base 12. The pivotal board 28 has dimensions similar to the horizontal cross section dimensions of the base 12 when the latter is in the erected condition. The wider front edge 29 of the pivotal board 28 is attached to the front panel 17 such that it is pivotable relative to the front panel as shown by the dotted line in FIG. 3. The length of the pivotal board 28 is longer than the width of the side panels 19 and 20 when the latter are in the erected condition. A horizontal slot opening 30 is formed in the rear panel 18 in a location slightly below the horizontal fold line 27. A narrower rear end portion 31 of the pivotal board 28 will engage with the slot opening 30 to hold the pivotal board 28 in the generally horizontal position so as to maintain the base 12 securely in the erected condition.

An operating opening 32 is formed in the pivotal board 28 at a location adjacent to the narrower rear end portion 31 and an elongated elastic cord 33 is attached at one end to the rear end portion 31 of the pivotal boars 28 and at the other end to a location adjacent to the top edge 34 of the rear panel 18. The elastic cord 33 is in the relax condition when the pivotal board 28 is located in the horizontal position with its rear end portion 31 engaged with the slot opening 30 of the rear panel 18. The base 12 may be folded to the collapsed condition by inserting a finger into the operating opening 32 and pulling the pivotal board 28 to disengage from the slot opening 30 and then pivoting downwards towards the front panel 17 as shown in the dotted line in FIG. 3, and in the meantime, pushing the side panels 19 and 20 inwards at the vertical fold lines 25 and 26 until the base 12 is in the collapsed condition.

A second elastic cord 34 may be mounted between the side panels 19 and 20 and locating above the pivotal board 28 and extending between and connected to the vertical fold lines 25 and 26. The elastic cord 34 is in tension when the base 12 is in the erected condition, so that when the pivotal board 28 is pivoted downwards, the tension of the elastic cord 34 will automatically pull the side panels 19 and 20 inwards towards one another, as best shown by the arrows in FIG. 4, so as to facilitate the folding of the base to the collapsed condition. In the erected condition of the base, the pivotal board 28 prevents the side panels 19 and 20 from being pulled inwards by the second elastic cord 34. The base 12 in the collapsed condition may further be folded along the horizontal fold line 27 as shown in FIGS. 5 and 6, so that it may be conveniently placed and packed in the tray 10 as shown in FIG. 6 with the merchandise for shipping, transporting, or storage.

Figure 2:
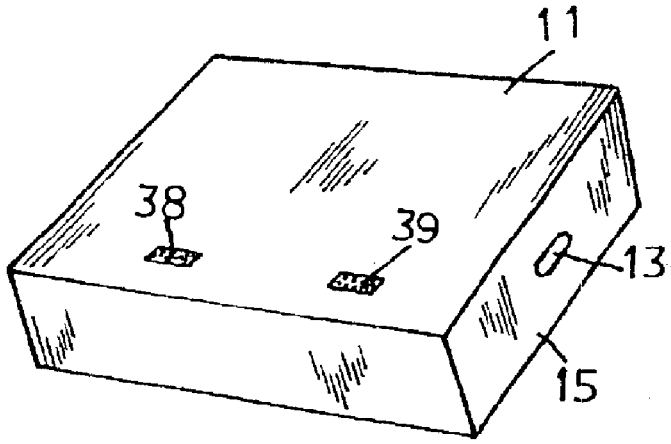
FIG. 2 is a bottom perspective elevation view of the tray with the tray showing the provision of attaching means which is operative for removably attaching the tray to the base.

An extension flap 35 pivotable relative to the top edge 34 of the rear panel 18 may extend outwards from this top edge. Mounting pads 36 and 37 having a plurality of fine hair-like clinging fingers such as VELCRO (trade mark) pads may be provided on the surface of the extension flap 35 and the associate mounting pads 38 and 39 as shown in FIG. 2 also provided on the underside of the tray 10 such that the mounting pads and the associate mounting pads cooperate to secure the tray 10 resting safely and removably on the base 12.

The base 12 may be erected from the collapsed condition by simply unfolding it from the horizontal fold line 27. The tension in the elastic cord 33 will automatically pull the pivotal board 28 back to the horizontal position until its rear end portion 31 engages with the slot opening 30. Since the dimension of the pivotal board 28 is same as the cross sectional dimension of the base in the erected condition, the pivotal board 28 would push the side panels 19 and 20 outwards against the elastic force of the elastic cord 39 until the base 12 is in the erected condition and it will maintain the base 12 rigidly in such erected condition.

The present invention may be carried out with various modifications without departing from the spirit or essential attributes thereof, and accordingly, reference should be made to the appended claims, rather than to the foregoing specification as indicating the scope of the invention.

What we claim is:

1. A display stand comprising, a hollow foldable self-erecting supporting base having a front panel, a rear panel, and two opposite side panels, a central vertical fold line formed at said side panels and extending the entire height of said side panels, a horizontal fold line formed around said base and located at a same horizontal plane of all of said front panel, said rear panel and said side panels, a pivotal board located within said base and positioned below said horizontal fold line, said pivotal board having one edge therein attached to said front panel and being pivotable relative to said front panel to locate between a horizontal position crosswise to said base, and a vertical downward position juxtaposed to said front panel, an elongated elastic cord having one end attached to a narrow free end portion of said pivotal board and another end attached to an upper edge portion of said rear panel, said elastic cord being extensible in an elastic tension when said pivotal board is in said vertical downward position, a horizontal slot opening formed in said rear panel and located below said horizontal fold line, said slot opening being engageable with said narrow free end portion of said pivotal board for maintaining said base in an erected condition, an operating opening formed in said pivotal board and located adjacent to said narrow free end portion therein, said pivotal board being pivotable by inserting a finger through said operating opening and pulling said pivotal board to pivot downward to said vertical downward position for creating said elastic tension in said elastic cord, a display tray disposable on top of said base when said base is in said erected condition.

2. A display stand according to claim 1 wherein said rear panel a taller height than said front panel, and said side panels have sloping top edges sloping from a top edge of said rear panel to a short distance below a top edge of said front panel whereby an upstanding lip portion is formed at said top edge of said front panel, said upstanding lip portion providing an abutment for a front edge of said display tray when said tray is disposed on said base in a downward sloping position.

3. A display stand according to claim 2 wherein said side panels are foldable inwards towards one another when said pivotal board is in said downward vertical position to fold said base into a collapsed condition.

4. A display stand according to claim 3 wherein said base is foldable along said horizontal fold line when said base is in said collapsed condition whereby said base is placeable within said display tray for shipping, transporting and storage.

5. A display stand according to claim 3 wherein said base is self-erecting to said erected condition when said base is unfolded from said collapsed condition along said horizontal fold line whereby said elastic tension of said elastic cord automatically pulls said pivotal board in a crosswise position with said narrow free end portion therein engaged with said horizontal slot opening in said rear panel.

6. A display stand according to claim 5 including a second elastic cord connected between said vertical fold line of said side panels and located above said pivotal board, said second elastic cord being in elastic tension when said base is in said erected condition, and being operative automatically to pull said side panels inwards towards one another when said pivotal board is in said downward vertical position.

7. A display stand comprising, a hollow foldable self-erecting supporting base made of a single card board material, said base having a front panel, a rear panel, and two opposite side panels, and said base having a larger bottom end than a top end therein, a central vertical fold line formed in said side panels and extending the entire vertical length therein, a horizontal fold line formed around said base and located at a same horizontal plane of all of said front panel, said rear panel, and said side panels, said rear panel having a height taller than said front panel, and said side panels having slanted top edge sloping from a top edge of said rear panel to a short distance below a top edge of said front panel whereby forming an upstanding top lip portion at said top edge of said front panel, a trapezoidal-shaped pivotal board located within said base and said pivotal board having a bent front edge attached to said front panel and a free rear end portion distal from said bent front edge, said pivotal board being pivotable selectively relative to said front panel to locate at a horizontal position transverse to said base, and at a vertical downward position juxtaposed to said front panel, a horizontal slot opening formed in said rear panel and located below said horizontal fold line, said slot opening being engageable with said free rear end portion of said pivotal board when said pivotal board is in a transverse position for maintaining said base in an erected condition, a first elastic cord having one end connected adjacent to said free rear end portion of said pivotal board and another end connected to a location just below said top edge of said rear panel, an operating opening formed in said pivotal board and located adjacent to said free rear end portion therein, said pivotal board being pivotable between said transverse position and said vertical downward position by inserting a finger into said operating opening and pulling said pivotal board to engage with said horizontal slot opening and pivoting downward against elastic tension of said first elastic cord to move to said downward vertical position whereby said side panels are foldable inwards towards one another to fold said base into a collapsed condition, a rectangular display tray disposable on said base when said base is in said erected condition.

8. A display stand according to claim 7 including a second elastic cord connected between said vertical fold line of said side panels and located above said pivotal board, said second elastic cord being in elastic tension when said base is in said erected condition, and said second elastic cord being operative to pull said side panels inwards towards one another when said pivotal board is pulled downwards to disengage with said horizontal slot opening of said rear panel.

9. A display stand according to claim 8 wherein said upstanding lip portion at said top edge of said front panel serves as an abutment to a front edge of said display tray when said tray is disposed in a forward sloping position on said base in an erected position.

10. A display stand according to claim 9 including a pivotal flap formed at said top edge of said rear panel, and mounting pads located on said pivotal flap, said mounting pads being engageable with associated mounting pads located at the underside of said display tray when said tray is disposed on said base in said erected condition for removably attaching said tray to said base.

11. A display stand according to claim 10 wherein said base in said collapsed condition is further foldable along said horizontal fold line whereby said base is placeable within said display tray for shipping, transporting and storage.

12. A display stand according to claim 11 wherein said base is self-erecting when unfolded relative to said horizontal fold line whereby said pivotal board pivots from said vertical downward position to said transverse position by said elastic tension of said first elastic cord.

* * * * *